US005678146A

United States Patent [19]

Boerger

[11] Patent Number: 5,678,146

[45] Date of Patent: Oct. 14, 1997

[54] MEASURING APPARATUS FOR COPYING A DOCUMENT ONTO A SHEET OF PAPER OF PRE-DETERMINED DIMENSIONS

[75] Inventor: Richard H. Boerger, Rochester, N.Y.

[73] Assignee: Xerox Corporation, Stamford, Conn.

[21] Appl. No.: 541,283

[22] Filed: Oct. 12, 1995

[51] Int. Cl.[6] ..... G03G 15/041

[52] U.S. Cl. ..... 399/197; 399/379

[58] Field of Search ..... 399/197, 196, 399/377, 379

[56] References Cited

U.S. PATENT DOCUMENTS

| | | | |
|---|---|---|---|
| 4,597,663 | 7/1986 | Yoshiura et al. | 355/200 |
| 4,666,289 | 5/1987 | Kawano | 355/243 |
| 4,682,877 | 7/1987 | Fujiwara et al. | 355/243 |
| 4,809,050 | 2/1989 | Ito | 355/14 SH |
| 4,961,090 | 10/1990 | Gray, Jr. et al. | 355/50 |
| 4,974,164 | 11/1990 | Lewis et al. | 364/562 |
| 5,150,224 | 9/1992 | Mizude et al. | 358/449 |

OTHER PUBLICATIONS

Canon NP3050 Instruction Manual, pp. 3–11, 1991.

*Primary Examiner*—Nestor R. Ramirez

[57] ABSTRACT

A measuring apparatus for determining the appropriate level of magnification to reproduce a document onto an output sheet with pre-determined dimensions is disclosed. The device may be mounted to the surface of the copy machine or it may be attached to the side of the platen glass. The original document is properly lined up with the measuring device, and horizontal and vertical magnification factors are read from both sides. The smaller of the two values is then entered into the magnification system of the copy machine. This will allow an original document of any size to be copied onto a sheet of paper with pre-determined dimensions. Several devices may be used together to form a set to allow the user to determine the appropriate magnification factor for a copy sheet with virtually any dimensions.

12 Claims, 11 Drawing Sheets

MEASURING APPARATUS FOR COPYING A DOCUMENT ONTO A SHEET OF PAPER OF PRE-DETERMINED DIMENSIONS

This invention relates generally to a measuring device useful in copying documents, and more particularly concerns an apparatus for determining the appropriate magnification factor for copying a document onto a sheet of paper with pre-determined dimensions.

BACKGROUND OF THE INVENTION

Documents output from xerographic printing machines can be produced in any size. However, it is impossible to supply any single machine with a copy paper supply that contains a wide enough variety of paper sizes to allow documents with any dimensions to be reproduced onto a copy sheet of exactly the same size. For this reason, the number of different sizes of output copy sheets that can be made available for a given copy machine must be limited. Limiting the available paper supply in this manner often means that it is necessary to copy a document onto a sheet that has dimensions which differ from those of the original. On some occasions, the original image must be reduced in size to enable the entire document to fit onto the copy. On other occasions, the original image will be much smaller than the copy sheet size, resulting in an excessive amount of blank area which makes the image difficult to read. Under these circumstances, the document must be enlarged to enable the entire image to fill the copy sheet, without leaving an excessive amount of blank material around the borders of the page.

While some copy machines are capable of automatically calculating the correct level of magnification, others require the user to manually enter the appropriate magnification value into their magnification systems. When manual input is required, the user will often attempt, through trial and error, to estimate the amount of magnification that is necessary to reproduce the entire document onto a copy sheet with the best fit. (Note: The term "magnification" refers to an alteration in the dimensions of the original document, regardless of whether that alteration in size is an enlargement or a reduction of the size of the original document.) That is, the user will attempt to guess at how much magnification will be required to reproduce the entire document onto the copy. This initial guess is entered into the magnification system of the copy machine, and the document is reproduced at that magnification level. This first guess is almost always incorrect, and will result in a copy that does not properly fit within the borders of the output sheet. The user must then select a new value by making a subsequent guess, based upon the results of the first guess, as to how much magnification is required. This new value is then entered into the magnification system and a second copy is produced. This process is continued until the appropriate factor is finally determined, and the entire document, with an acceptable border size, is copied onto the desired copy sheet. This method of calculating the appropriate magnification factor obviously results in a significant amount of wasted time and paper.

Photocopiers that produce copies on paper with dimensions that differ from those of the original document often do so by making mechanical adjustments to the relative locations of various parts within the machine. For example, U.S. Pat. No. 5,150,224 discloses an image forming apparatus comprised of a copy paper feeder with copy sheets having different sizes, and a device for copying an image onto a copy sheet which is capable of varying the level of magnification. In one mode of operation, the user will select the desired copy paper size, and the image will automatically be magnified to a level that will enable it to fit properly onto the copy. In another mode, the same invention will enable the user to select both the desired copy size and the desired magnification, and the image will be copied onto the copy paper at the selected magnification. Alternatively, electronic image processing to obtain magnification is possible.

There is a need, which the present invention addresses, for new apparatus which will allow a user to determine the appropriate level of magnification at which an original document will be copied onto an output copy sheet.

The following disclosures may be relevant to various aspects of the present invention:

U.S. Pat. No. 4,974,164 discloses a hand held microcomputer based electro-optical device which determines the proportioning factor, expressed as a percentage, required to enlarge or reduce an original to fit properly within an allocated space. The device is typically used in the graphic arts field, and is capable of measuring distances in inches, centimeters, picas or in other user defined units, and is capable of converting between these unit systems.

U.S. Pat. No. 4,961,090 discloses a system for making large copies by moving a document past an optical scanning device at a predetermined rate of speed. The rate of speed at which the document moves past the scanner can be varied to produce copies with dimensions that are either smaller or larger than those of the original copy. This system includes a method of deriving a numerical correction factor that corresponds to the required change in dimensions, and entering the correction factor into a variable speed control to reset the speed at which the document moves past the optical scanning device.

U.S. Pat. No. 4,809,050 discloses a copying machine which is capable of reproducing a document image at various magnification levels. Means for detecting the size of the original document to be copied, for designating the appropriate copying magnification, and means for designating the best copy paper size are provided.

All of the references cited herein are incorporated by reference for their teachings.

SUMMARY OF THE INVENTION

In accordance with one aspect of the present invention, a method of determining the appropriate magnification factor to copy a document onto a selected sheet of output copy paper is disclosed, comprising placing the document next to a measuring instrument, reading a horizontal magnification factor from a horizontal side of a measuring instrument, reading a vertical magnification factor from a vertical side of said measuring instrument, and entering the smaller of the two magnification factors into a magnification system of a copying machine.

Another aspect of this invention discloses a bi-directional measuring instrument for a surface of a printing machine from which a magnification factor required to copy an original document of any size onto a sheet of output copy paper with a pre-determined size can be read comprising a rectangular shaped mat, divisional markings provided in a horizontal direction and in a vertical direction on a surface of said mat, and numerical values provided on said surface of said mat and associated with said horizontal and vertical divisional markings.

Yet another aspect of this invention discloses a bi-directional measuring instrument for a platen of a printing machine from which a magnification factor required to copy an original document of any size onto a sheet of output copy paper with a pre-determined size can be read comprising a horizontal strip, a vertical strip mounted with said horizontal strip, divisional markings provided on a surface of said horizontal strip and on a surface of said vertical strip, and numerical values provided on said surface of said horizontal strip and on said surface of said vertical strip and associated with said divisional markings.

Still another aspect of this invention discloses a bi-directional measuring instrument set for a platen of a printing machine from which the magnification factor required to copy original documents with varying sizes onto output copy sheets with selected dimensions can be read comprising a plurality of bi-directional measuring instruments, said plurality of bi-directional measuring instruments mounted together to form a single unit.

BRIEF DESCRIPTION OF THE DRAWINGS

These and other aspects of the present invention will become apparent as the following description proceeds and upon reference to the Figures which represent preferred embodiments.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

Figure 2:
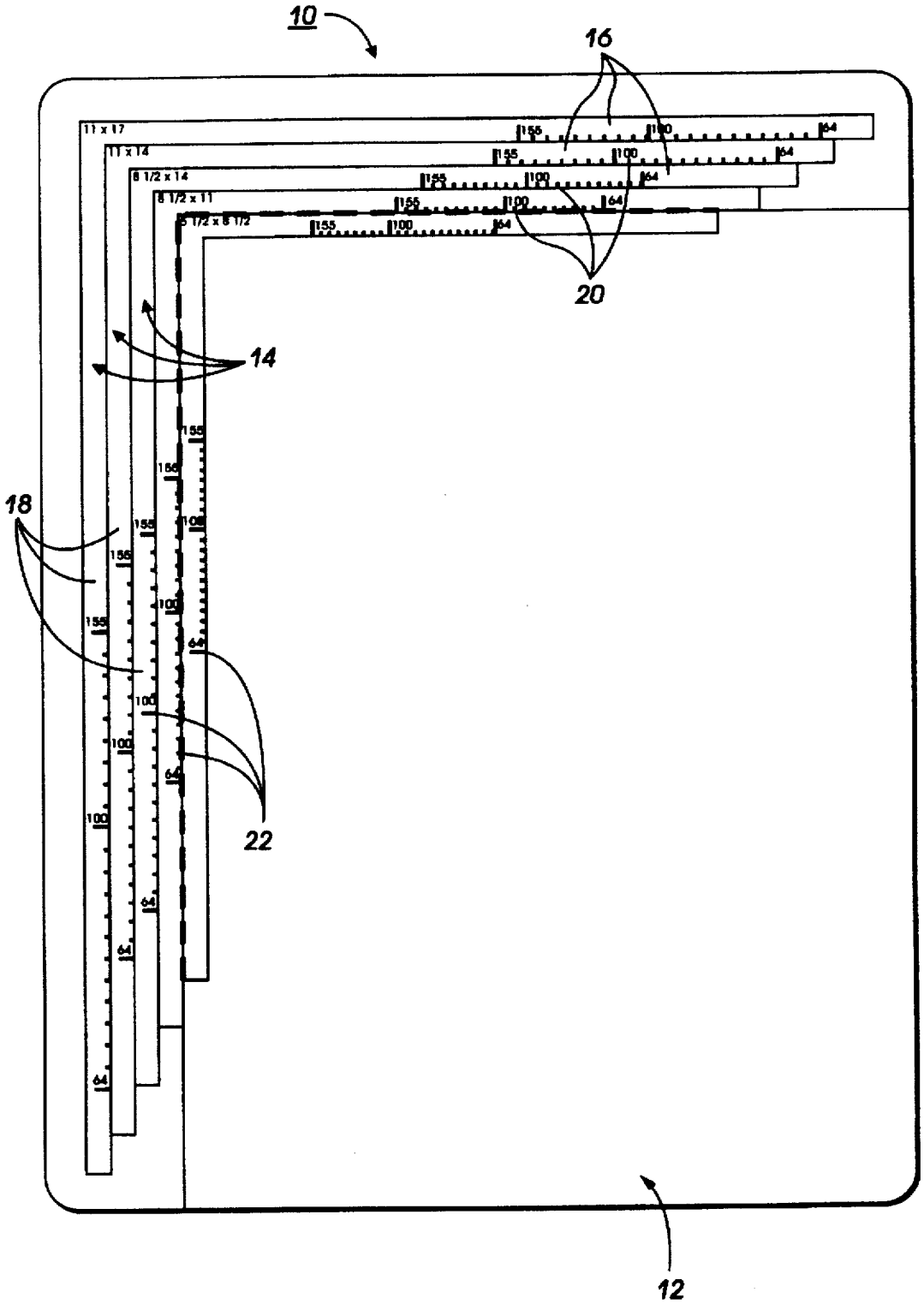
FIG. 2 depicts a measuring plate which can be attached to a surface of a photocopy machine.

Referring now to the drawings where the showings are for the purpose of describing an embodiment of the invention and not for limiting same, a measuring plate 10 is depicted in FIG. 2. This embodiment of the invention consists of a rectangular mat 12 with rows and columns of divisional markings and numerical values printed upon it. As depicted in the drawing, the left side of each row is attached to the top of a different column. Each row and column combination creates an inverted L shaped measuring unit 14 of divisional markings and numerical values with one horizontal axis 16 and one vertical axis 18. Several inverted L shaped measuring units 14 are placed echelon on rectangular mat 12, one for each output copy sheet size that is available for the copy machine being used.

Figure 1:
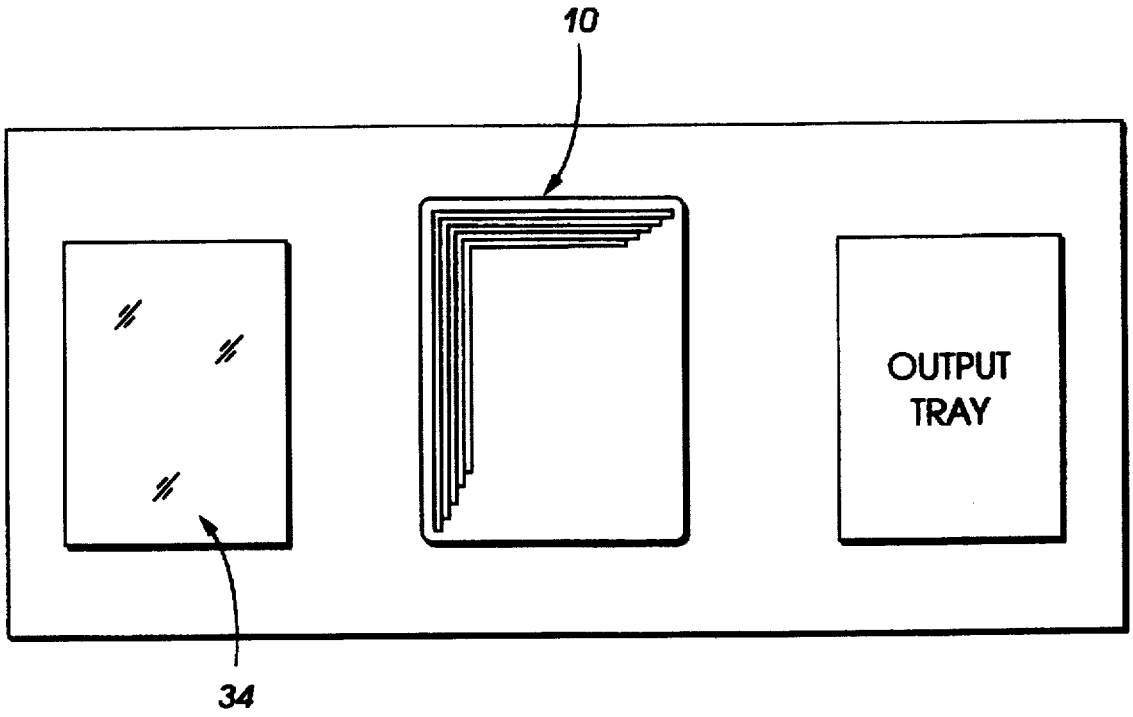
FIG. 1 depicts a plan view of a typical photocopying machine.

Measuring plate 10 can be placed on any flat surface on the photocopy machine. The underside of measuring plate 10 should be treated with an adhesive in order to facilitate attachment of plate 10 to the copy machine. It is possible to use means other than an adhesive to attach plate 10 to the copy machine, and the invention is not limited to this embodiment. An example of a suitable location for placement of measuring plate 10 is depicted in FIG. 1. Measuring plate 10 is used to determine the amount of magnification or reduction that is required to reproduce original documents whose dimensions vary over a wide range of values onto selected copy sheets whose dimensions are pre-determined. Referring again to FIG. 2, the divisional markings are placed such that the user can read a horizontal magnification factor 20 and a vertical magnification factor 22 to the nearest whole number. These magnification factors 20 and 22 range in value from a minimum of 64 to a maximum of 155. The magnification factors 20 and 22 express the percentage of the original size of the document to which the image must be magnified in order for it to be properly reproduced onto the copy sheet. The range in value of magnification factors 20 and 22 corresponds to those values that are typically accepted by magnification systems of photocopying machines. The range can be increased or decreased if the measuring plate 10 will be used with a photocopy machine that is capable of magnifying documents over a wider or narrower range of magnification levels. The numerical values that will be read from the measuring device 10 are calculated according to the following equation:

$$\text{MAGNIFICATION FACTOR} = \frac{\text{COPY DIMENSION} \times 100}{\text{ORIGINAL DOCUMENT DIMENSION}}$$

Figure 3:
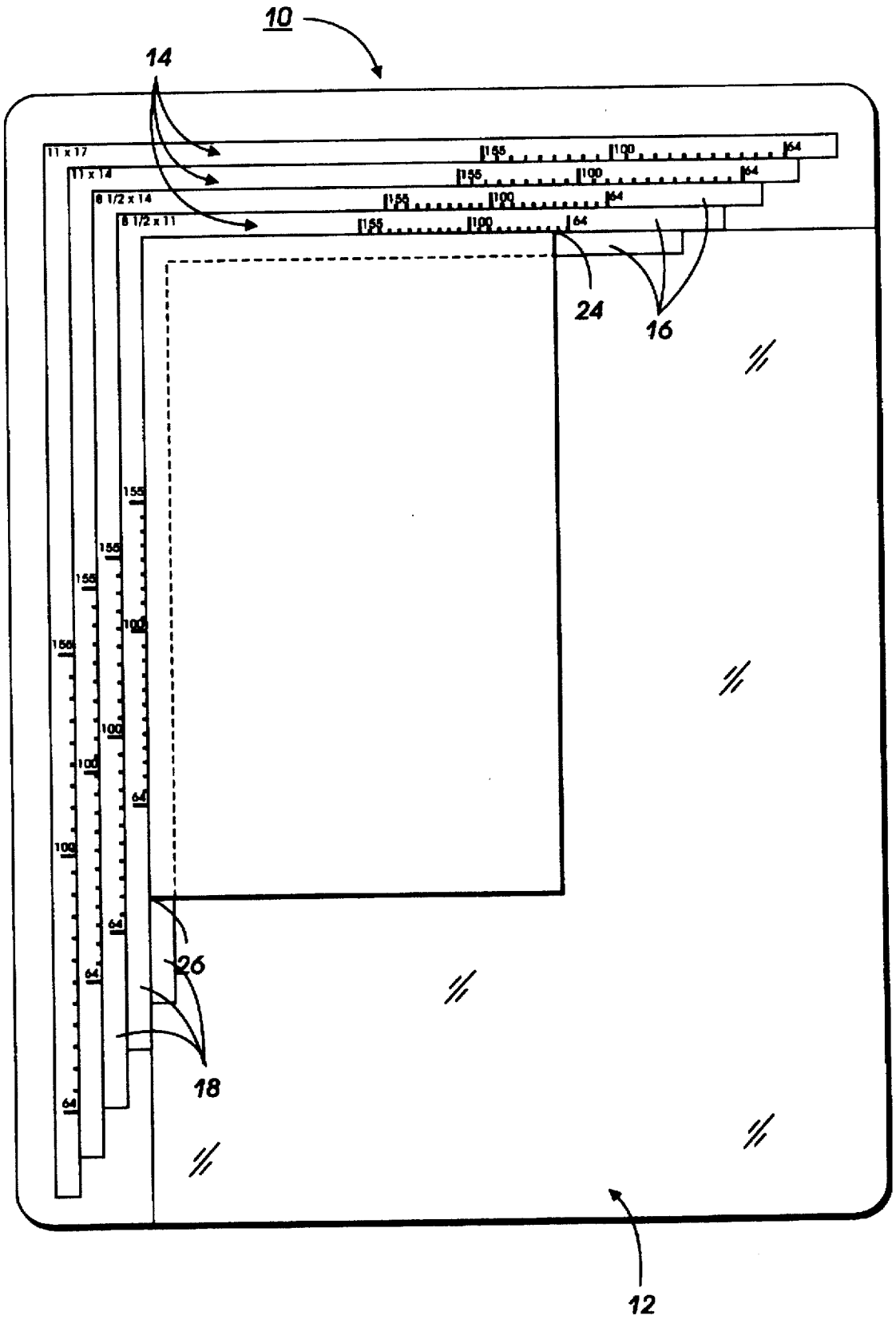
FIG. 3 depicts an original document after it has been placed upon a measuring plate.
Figure 11:
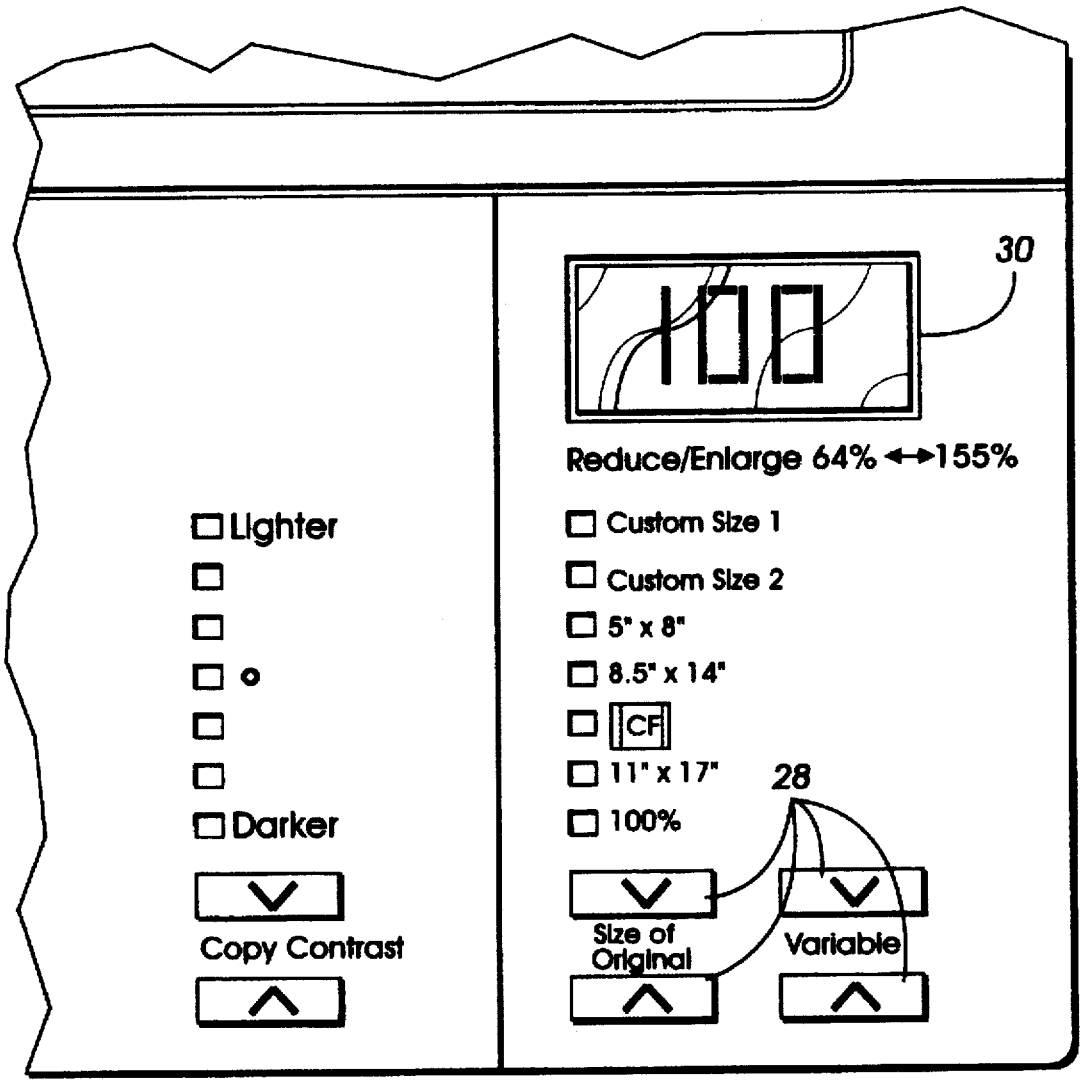
FIG. 11 depicts a the display unit of a typical photocopying machine, and the location at which the magnification value will be entered.

The user of this invention must first determine the appropriate size for the output copy sheet. Referring now to FIG. 3, the original document should then be placed onto the measuring plate 10 adjacent to the inside edge of the inverted L shaped measuring unit 14 which corresponds to the selected output copy sheet. The user must then take note of the horizontal point 24 and the vertical point 26 at which the edges of the document contact the horizontal axis 16, and vertical axis 18 of the L shaped measuring unit 14 which corresponds to the selected output copy sheet size. The horizontal magnification factor 20 and vertical magnification factor 22 are then read at the horizontal 24 and vertical 26 points on the inverted L shaped measuring unit 14. Using the arrows 28 depicted in FIG. 11, the appropriate value is entered into the magnification system of the copy machine. This value can be viewed at the window 30 located on the display unit of the copy machine.

Only one magnification factor 20 or 22 will be entered into the magnification system of the photocopy machine. This means that the entire document will be magnified by the same amount in both directions. When the horizontal factor 20 and vertical factor 22 do not provide a height-width ratio that is equal to that of the desired output copy sheet format, the operator must enter the smaller of the two magnification factors 20 or 22 into the magnification system. In other words, if the magnification factors for the horizontal axis 16 and vertical axis 18 for the same document are not identical, the operator must copy the document at the smaller of the two magnification factors 20 and 22 in order to magnify the image such that the entire original document is reproduced onto the copy sheet. If the document will be reproduced onto a copy whose dimensions are smaller than those of the original, (i.e. the original will be reduced in size), one or both of the magnification factors 20 or 22 will have a value between 1 and 100. If the original document will be reproduced onto a copy sheet with dimensions that are larger than those of the original (the document will be enlarged), both magnification factors 20 and 22 will be greater than 100.

The numerical values on the horizontal or "width" axis 16 of the scale have been calculated separately from those on the vertical or "length" axis 18. For example, if the operator wishes to copy a document that measures 9.5 inches wide by 13.0 inches long, onto a 8.5×11.0 sheet of paper, the appropriate width reduction factor will read 8.5×100/9.5=89 and the appropriate length factor will read 11.0×100/13.0=85. The operator would then copy the original document to a magnification level of 85% of its original size in order to copy the entire document onto an 8.5×11.0 sheet of paper. If the operator wishes to copy a document that measures 13 inches wide by 9.5 inches long, onto the same 8.5×11.0 copy sheet, the appropriate width magnification factor will read 8.5×100/13.0=65 and the appropriate length factor will read 11.0×100/9.5=116. The operator would then copy the original document to a magnification level of 65% of its original size in order to copy the entire document onto the 8.5×11.0 sheet of paper and retain the appropriate border size. As indicated by this example, if either or both of the magnification factors has a value less than 100%, the original image will be reduced in size in order to fit onto the copy sheet. However, if the user wishes to copy a document that measures 9.5 inches wide by 13.0 inches long onto an 11.0×17.0 copy sheet, the horizontal magnification factor will read 11.0×100/9.5=116, and the vertical magnification factor will read 17.0×100/13.0=131. Since both factors are greater than 100, the document will be enlarged to 116% of its original size.

Figure 4:
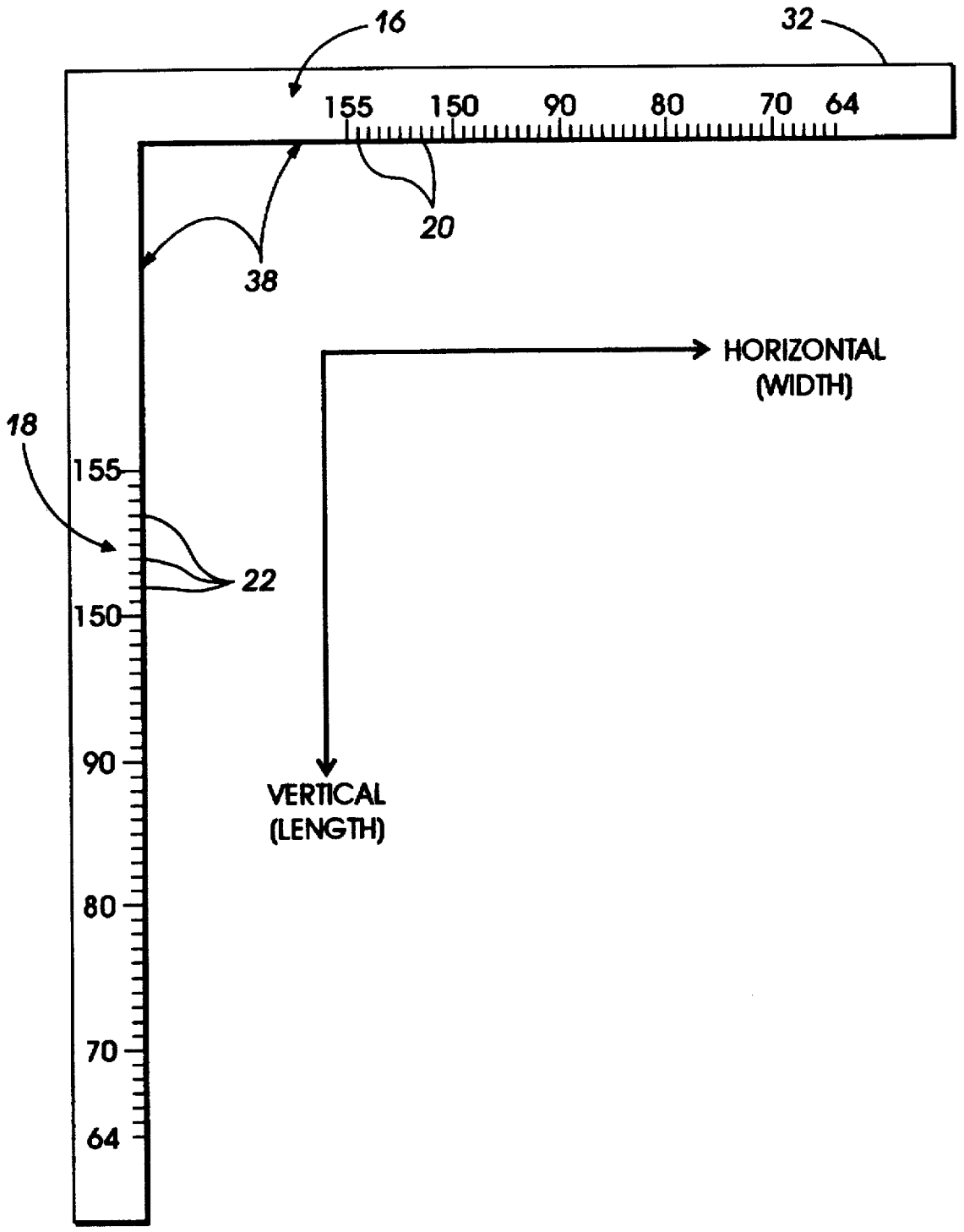
FIG. 4 depicts a single bi-directional measuring instrument which can be attached to the platen of the printing machine.

A second embodiment of this invention is a bi-directional measuring device 32, depicted in FIG. 4. Divisional markings and numerical values are also printed along the horizontal axis 16 and vertical axis 18 of the bi-directional measuring device 32. This embodiment of the invention operates in a manner similar to that previously described. Thus, the divisional markings and numerical values are placed such that the user can read the magnification factors 20 and 22 to the nearest whole number, the magnification factors 20 and 22 range in value from a minimum of 64 to a maximum of 155, and the range of magnification values can be altered if the measuring device 32 will be used with a photocopy machine that is capable of magnifying documents over a wider or narrower range of magnification levels. The numerical values that will be read from the measuring device 32 are calculated according to the same mathematical relationship that was disclosed in the previous embodiment of the invention:

$$\text{MAGNIFICATION FACTOR} = \frac{\text{COPY DIMENSION} \times 100}{\text{ORIGINAL DOCUMENT DIMENSION}}$$

This embodiment of the invention requires the use of a different measuring device 32 for each different size of output copy sheet that is available for use with the given copy machine. The user must select the size of the output copy sheet onto which the original document will be copied. The corresponding measuring device 32 must then be placed at the appropriate location next to the platen 34 of the copy machine.

Figure 5:
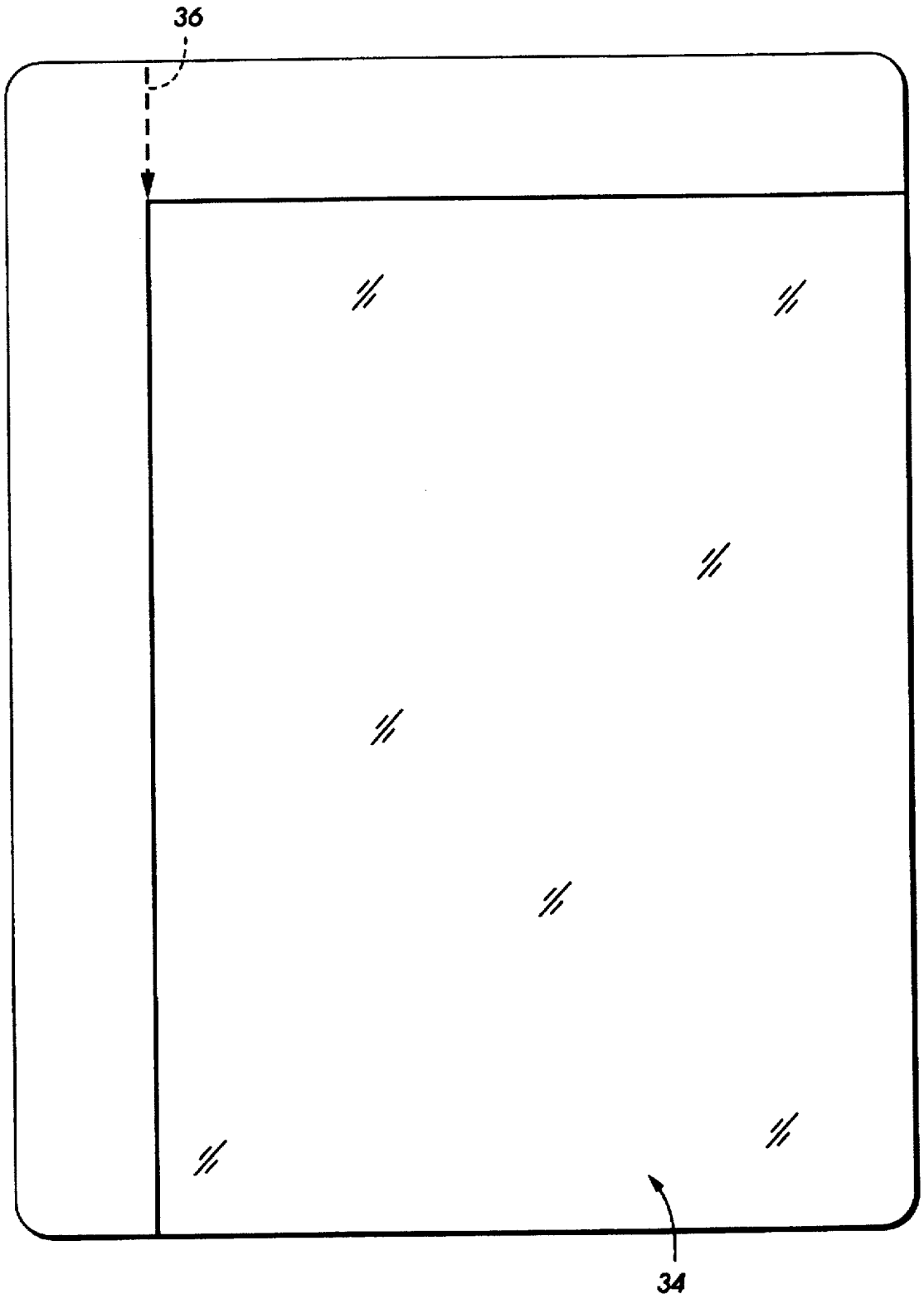
FIG. 5 depicts a typical copy machine platen.
Figure 6:
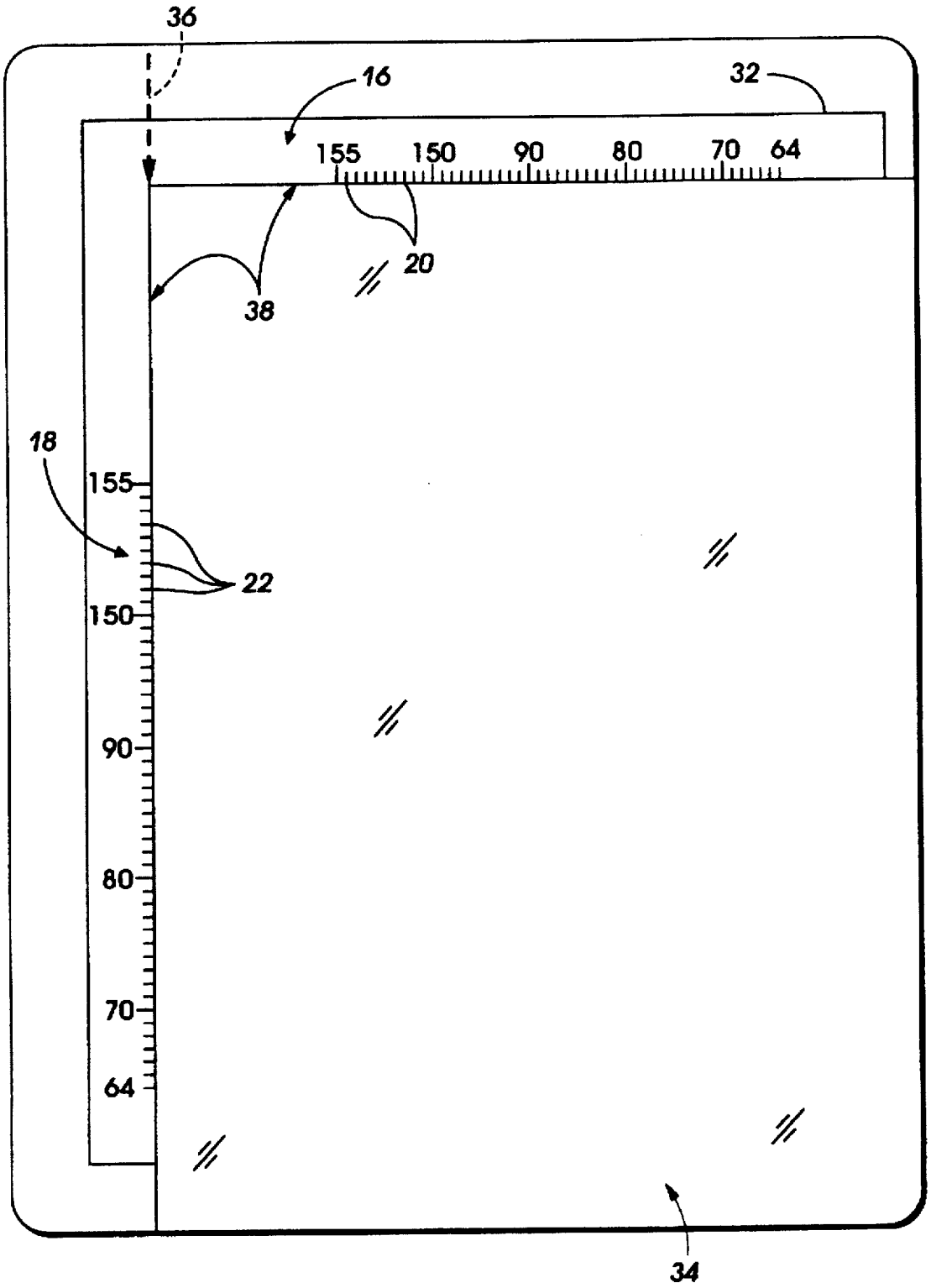
FIG. 6 depicts a bi-directional measuring instrument which has been placed on the platen of a copy machine.

A typical photocopy machine platen 34 is shown in FIG. 5. An example of the "appropriate location" for placement of the measuring device 32 is defined by a reference point 36 which must be located somewhere on the surface of the photocopy machine. Placing the measuring device 32 relative to the reference point 36 will ensure that the original document lies within the boundaries of the photocopy area of the machine, and that the image will be appropriately reproduced on the output copy. The reference point 36 may be an arrow located at the top, left edge of the platen 34 as depicted in the illustration, or it may be any other indicator that will perform the same function. The inside edge 38 of the measuring device 32 must be placed next to the platen 34, lined up adjacent to the boundary of the photocopy area as depicted in FIG. 6.

Figure 7:
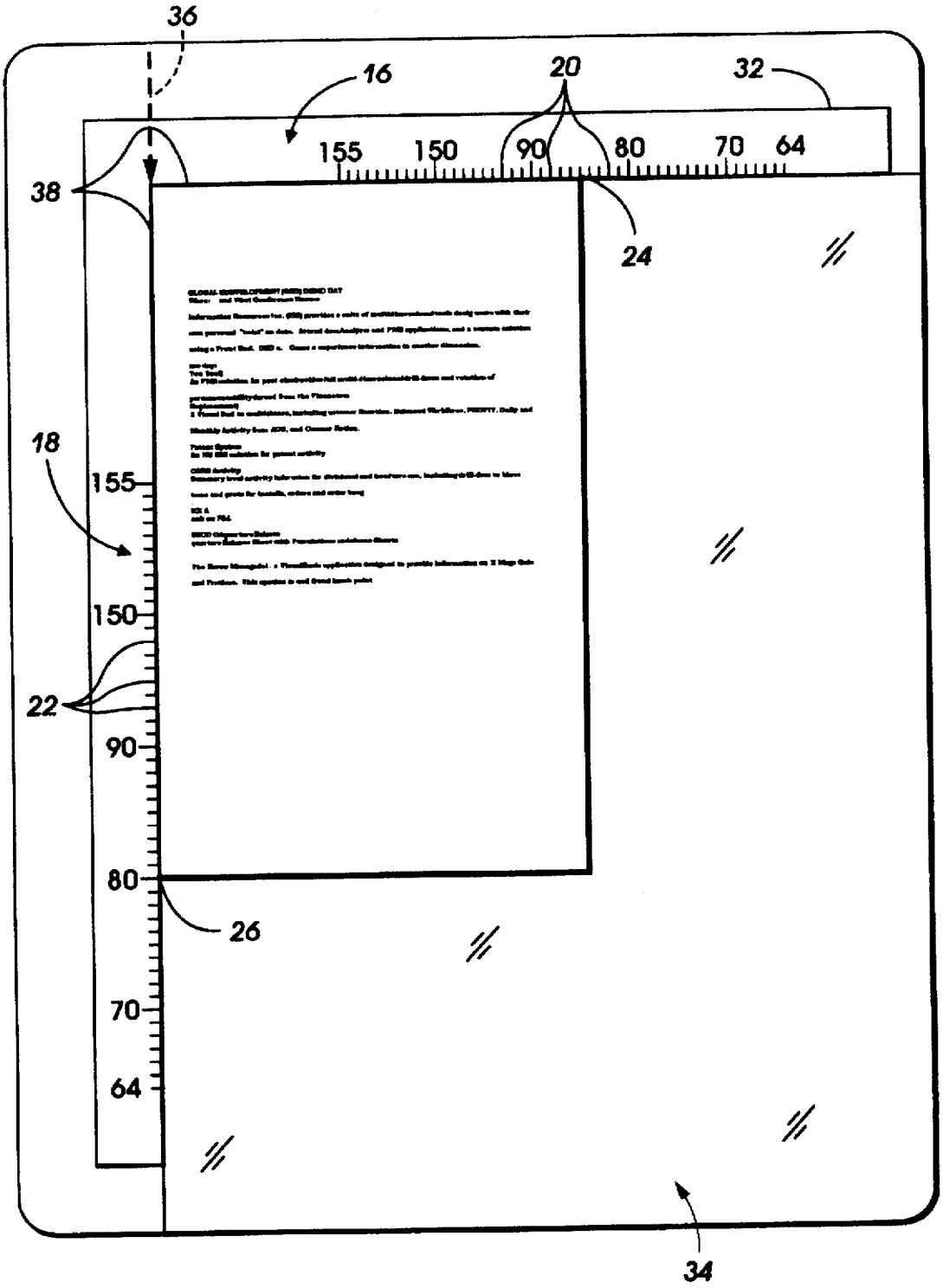
FIG. 7 depicts an original document after it has been placed on top of a bi-directional measuring instrument on top of a copy machine platen.

Once the measuring device 32 has been placed at the proper location, the document should be placed on the platen 34, adjacent to the measuring device 32 as shown in FIG. 7. As previously explained, the user must then take note of the horizontal point 24 and the vertical point 26 at which the edges of the document contact the horizontal axis 16, and vertical axis 18 of the measuring device 32. The horizontal magnification factor 20 and vertical magnification factor 22 are then read at the horizontal 24 and vertical 26 points on the measuring device 32. Using the arrows 28 depicted in FIG. 11, the appropriate value is entered into the magnification system of the copy machine. This value can be viewed at the window 30 located on the display unit of the copy machine.

Figure 8:
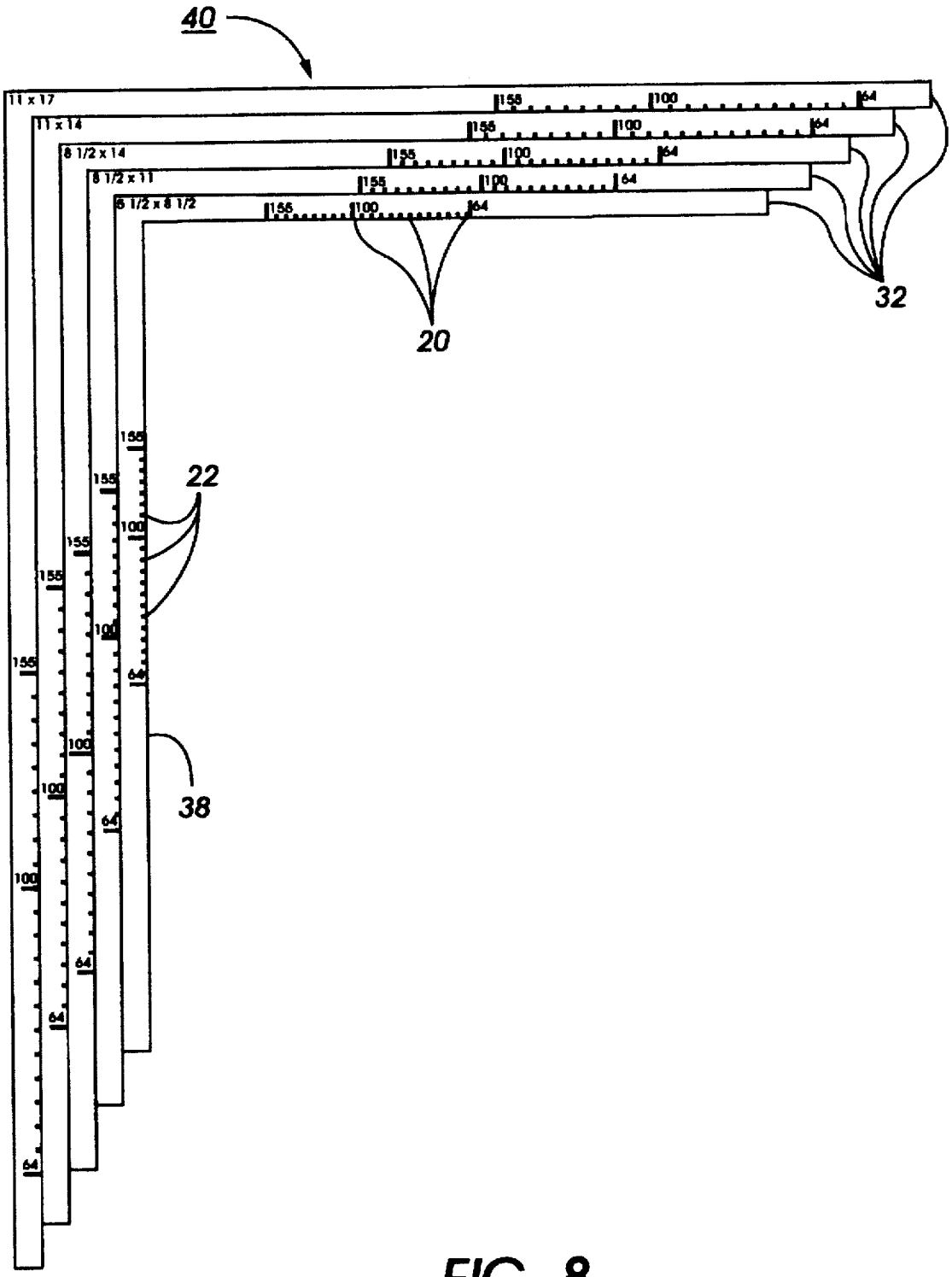
FIG. 8 depicts a bi-directional measuring instrument set which is comprised of several bi-directional measuring instruents that have been mounted together for attachment to a copy machine platen.

FIG. 8 depicts yet another embodiment of this invention, in which several of the bi-directional measuring devices 32 have been mounted together to form a set 40, which can be placed next to the platen 34. When the original document is placed next to set 40, the horizontal magnification factor 20 and vertical magnification factor 22 can be read for any output copy sheet with dimensions that correspond to any of the measuring devices 32 of which set 40 is comprised. The numerical scale on each individual measuring device 32 has been adjusted to account for the increased distance between the device and the edge of the platen 34 which results from mounting the measuring devices 32 together. The surface area surrounding the platen 34 may also have to be increased to enable the desired number of devices to be mounted next to the platen 34.

Figure 9:
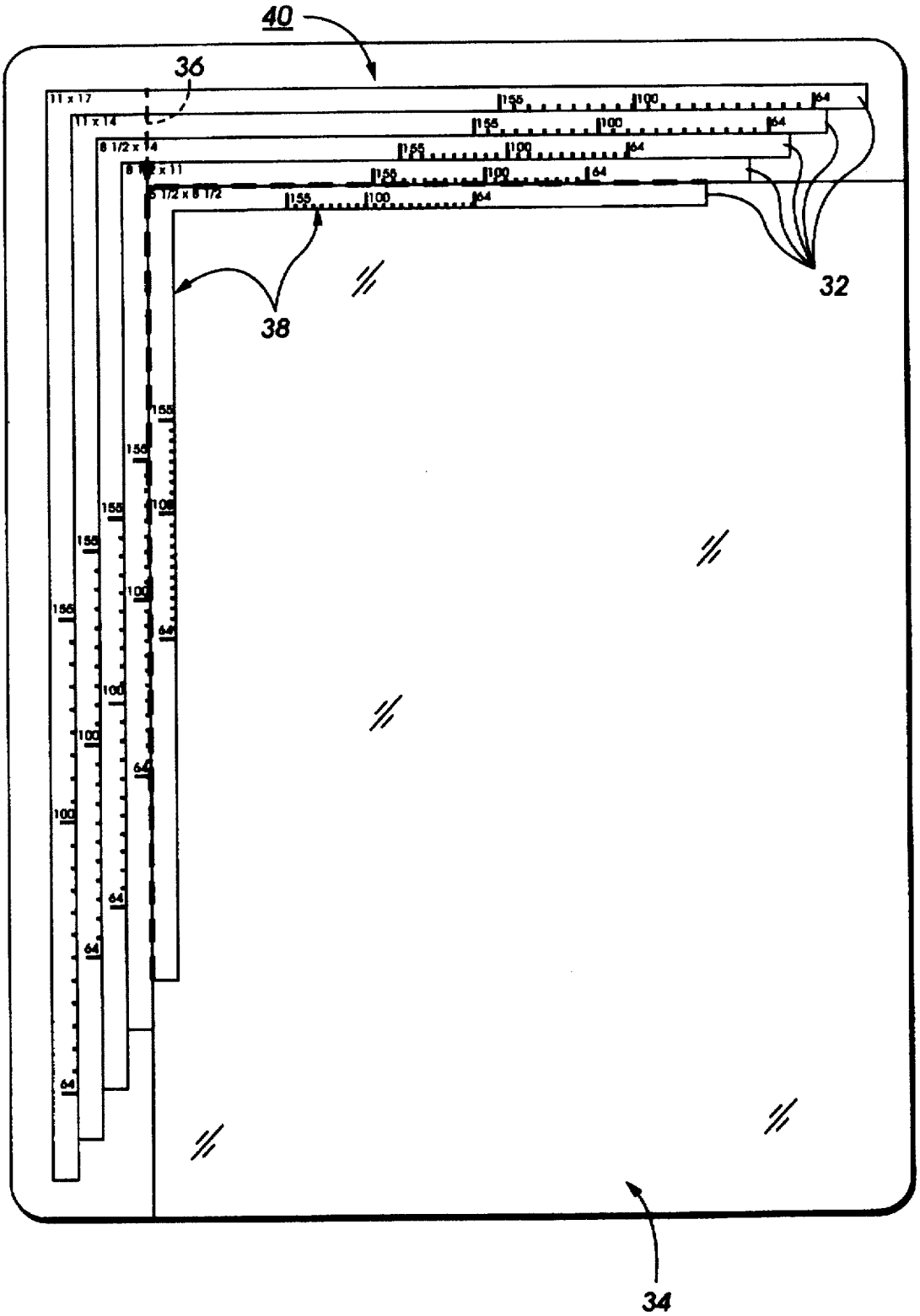
FIG. 9 depicts a bi-directional measuring instrument set after it has been placed on a copy machine platen.
Figure 10:
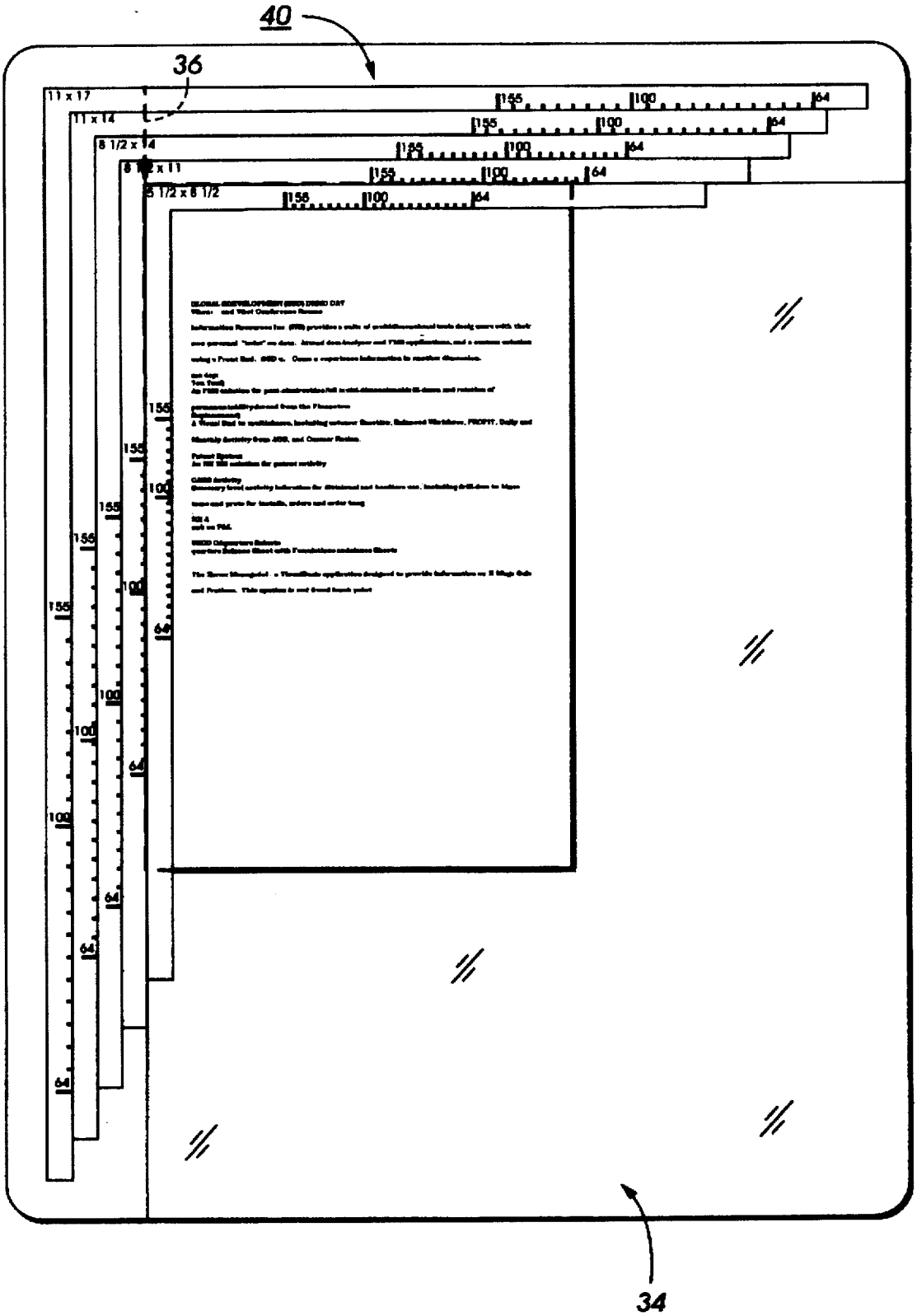
FIG. 10 depicts an original document after it has been placed on top of a bi-directional measuring instrument set on top of a copy machine platen.

FIG. 9 depicts a set 40 of measuring devices 32 after they have been mounted together and placed next to the copy machine platen 34. Each measuring device 32 that has been attached to the others has its own inside edge 38. When this embodiment of the invention is used, the inside edge 38 which must be lined up with the reference point 36 will be that of the measuring device 32 which corresponds to the dimensions of the output copy sheet. The original document will have to be placed between the platen 34 and the measuring device 32 of the set 40 that would be used to reproduce an image on a smaller output copy sheet as shown in FIG. 10.

This embodiment enables a set 40 of magnification devices 32 to be provided with each photocopy machine such that a user can easily determine the amount of magnification that would be required to copy a single original document onto an output sheet with any of the designated output copy sizes.

The present invention has significant advantages over current methods of copying original documents at varied magnification levels. This invention provides a reliable means for determining the magnification required to copy an original document onto one of several sheets of paper with different dimensions. It enables the operator of a copy machine to simply read the appropriate magnification factor from the platen of a copy machine on which a document is placed. This eliminates the need for random guessing, and results in significant savings of both time and paper. It can be made from materials that will only increase the cost of the photocopying system by a minimal amount.

It is, therefore, apparent that there has been provided in accordance with the present invention, a measuring device for determining the appropriate magnification or reduction factor for copying a document onto a sheet of paper with different dimensions that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A method of determining the appropriate magnification factor to copy a document onto a selected sheet of output copy paper comprising:

a) placing the document next to a measuring instrument;

b) reading a horizontal magnification factor from a horizontal side of said measuring instrument;

c) reading a vertical magnification factor from a vertical side of said measuring instrument; and d) entering the smaller of the two magnification factors into a magnification system of a copying machine.

2. A bi-directional measuring plate for a surface of a printing machine from which a magnification factor required to copy an original document of any size onto a sheet of output copy paper with a predetermined size can be read comprising:

a) a rectangular mat;

b) divisional markings provided in a horizontal direction and in vertical direction on a surface of said mat; and c) numerical values provided on said surface of said mat and associated with said horizontal and vertical divisional markings said numerical values being magnification factors readable from the measuring instrument.

3. The measuring instrument of claim 2, wherein said rectangular mat is removable from and replaceable to the surface of the printing machine.

4. The measuring instrument of claim 2 wherein an underside of said rectangular mat is made from an adhesive material.

5. The measuring instrument of claim 2 wherein each of said magnification factors, in terms of a dimension of the original document and a dimension of the output copy paper is defined as:

$$\text{MAGNIFICATION FACTOR} = \frac{\text{COPY DIMENSION} \times 100}{\text{ORIGINAL DOCUMENT DIMENSION}}.$$

6. A bi-directional measuring instrument for a platen of a printing machine from which a magnification factor required to copy an original document of any size onto a sheet of output copy paper with a pre-determined size can be read comprising:

a) a horizontal strip;

b) a vertical strip mounted with said horizontal strip;

c) divisional markings provided on a surface of said horizontal strip and on a surface of said vertical strip; and d) numerical values provided on said surface of said horizontal strip and on said surface of said vertical strip and associated with said divisional markings said numerical values being magnification factors readable from the measuring instrument.

7. The measuring instrument of claim 6, wherein said horizontal strip and said vertical strip are removable from and replaceable to the surface of the platen.

8. The measuring instrument of claim 6, wherein each of said magnification factors, in terms of a dimension of the original document and a dimension of the output copy paper is defined as:

$$\text{MAGNIFICATION FACTOR} = \frac{\text{COPY DIMENSION} \times 100}{\text{ORIGINAL DOCUMENT DIMENSION}}.$$

9. A bi-directional measuring instrument set for a platen of a printing machine from which the magnification factor required to copy original documents with varying sizes onto output copy sheets with selected dimensions can be read comprising:

a) a plurality of bi-directional measuring instruments;

b) said plurality of bi-directional measuring instruments mounted together to form a single unit.

10. The bi-directional measuring instrument set of claim 8, wherein each of said bi-directional measuring instruments comprises:

a) a horizontal strip;

b) a vertical strip mounted to said horizontal strip;

c) divisional markings on a surface of said horizontal strip and on a surface of said vertical strip; and d) numerical values provided on said surface of said horizontal strip and on the surface of said vertical strip and associated with said divisional markings.

11. The bi-directional measuring instrument set of claim 10, wherein:

a) each of said magnification factors, in terms of a dimension of the original document and a dimension of the desired output copy is defined as:

$$\text{MAGNIFICATION FACTOR} = \frac{\text{COPY DIMENSION} \times 100}{\text{ORIGINAL DOCUMENT DIMENSION}}.$$

12. The bi-directional measuring instrument set of claim 9, wherein each of said numerical values are magnification factors which are readable from said surfaces of the measuring instrument.

* * * * *